US006838399B1

(12) United States Patent
Deka et al.

(10) Patent No.: US 6,838,399 B1
(45) Date of Patent: Jan. 4, 2005

(54) FIBROUS LAYER PROVIDING IMPROVED POROSITY CONTROL FOR NONWOVEN WEBS

(75) Inventors: Ganesh Chandra Deka, Duluth, GA (US); Margaret Gwyn Latimer, Alpharetta, GA (US); Charles Allen Smith, Snellville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 259 days.

(21) Appl. No.: 09/727,857

(22) Filed: Dec. 1, 2000

(51) Int. Cl.[7] ..... B32B 27/04; D04H 1/00; D04H 13/00; D04H 1/56

(52) U.S. Cl. ..... 442/118; 442/340; 442/344; 442/400; 442/401

(58) Field of Search ..... 442/340, 411, 442/118

(56) References Cited

U.S. PATENT DOCUMENTS

| | | | | |
|---|---|---|---|---|
| 3,802,817 | A | 4/1974 | Matsuki et al. | 425/66 |
| 4,100,324 | A | 7/1978 | Anderson et al. | 428/288 |
| 4,640,810 | A | 2/1987 | Laursen et al. | 264/518 |
| 4,655,758 | A | 4/1987 | Ring et al. | 604/374 |
| 4,767,825 | A | 8/1988 | Pazos et al. | 525/408 |
| 4,818,464 | A | 4/1989 | Lau | 264/510 |
| 4,883,709 | A | 11/1989 | Nozaki et al. | |
| 5,114,849 | A | 5/1992 | Ben-Bassat et al. | 435/101 |
| 5,151,320 | A | 9/1992 | Homonoff et al. | |
| 5,273,891 | A | 12/1993 | Byrom | 435/101 |
| 5,277,976 | A | 1/1994 | Hogle et al. | 428/397 |
| 5,284,703 | A | 2/1994 | Everhart et al. | |
| 5,580,348 | A | 12/1996 | Blaney et al. | 604/367 |
| 5,759,926 | A | 6/1998 | Pike et al. | 442/333 |
| 5,772,646 | A | 6/1998 | Blaney et al. | 604/367 |
| 5,935,883 | A | 8/1999 | Pike | 442/340 |
| 6,395,957 | B1 * | 5/2002 | Chen et al. | 604/381 |

FOREIGN PATENT DOCUMENTS

| | | | |
|---|---|---|---|
| EP | 0 186 495 | 7/1986 | C12P/19/04 |
| EP | 0 279 506 | 8/1988 | C12P/19/04 |
| EP | 0 323 717 | 7/1989 | C12P/19/04 |
| EP | 1 050 612 | 11/2000 | |
| GB | 2 131 701 | 6/1984 | A61L/15/03 |

* cited by examiner

*Primary Examiner*—Deborah Jones
*Assistant Examiner*—Christopher Pratt
(74) *Attorney, Agent, or Firm*—William D. Herrick

(57) ABSTRACT

There is provided and fibrous layer for personal care products wherein the fibrous layer is made from micro-fine fibers deposited as an aqueous slurry onto a nonwoven web, and subsequently dried. The micro-fine fibers have a diameter from a positive amount to 0.5 microns. The nonwoven web may be produced from a number of methods, such as meltblowing, spunbonding, coforming, bonding and carding, and airlaying. The micro-fine fiber layer can be used to adjust the permeability of the nonwoven web, thus providing a method of controlling the rate of fluid movement through a personal care product, like diapers, training pants, incontinence garments and feminine hygiene products.

14 Claims, 1 Drawing Sheet

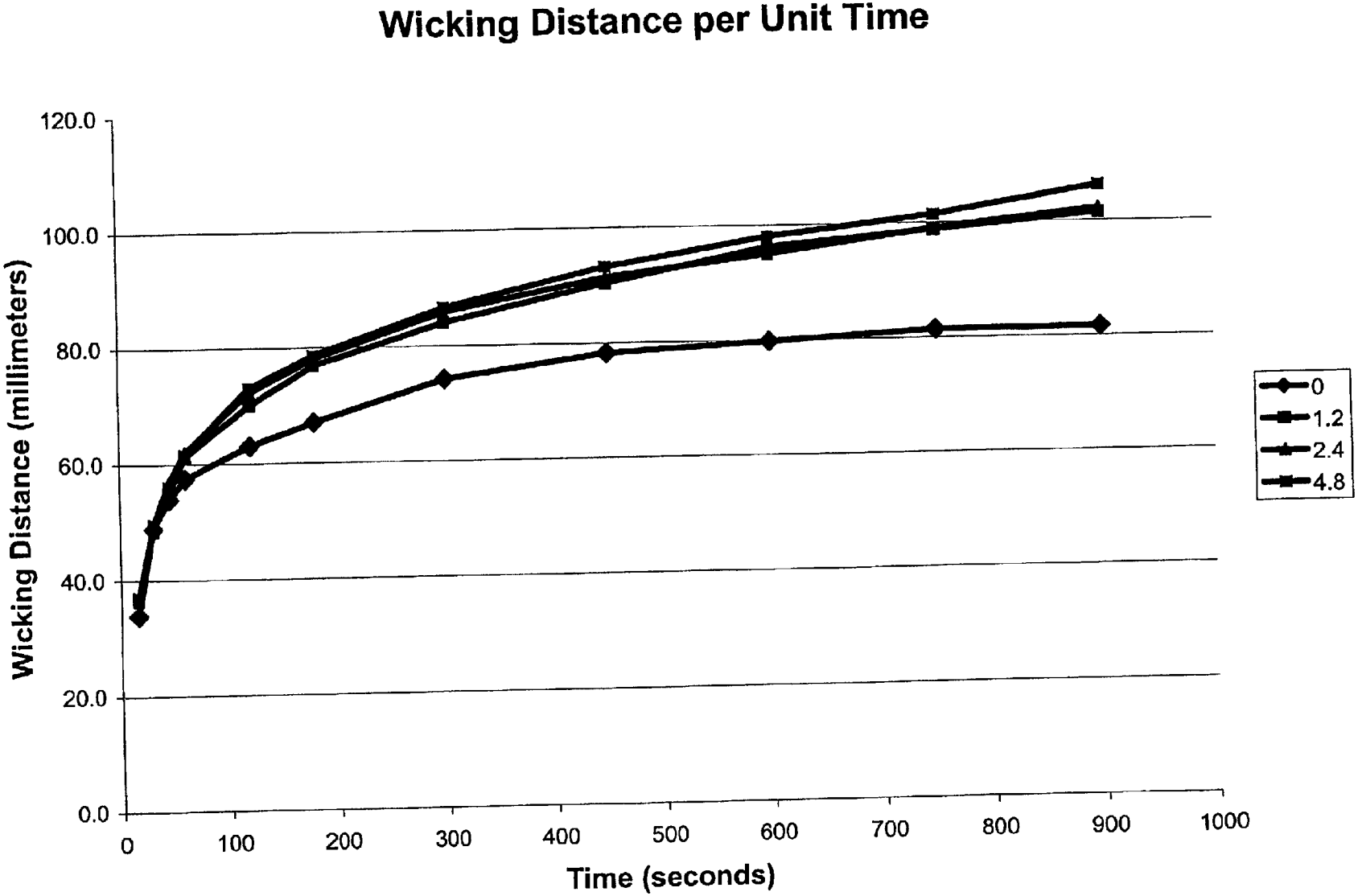
Wicking Distance per Unit Time
0
1.2
2.4
4.8
Wicking Distance (millimeters)
120.0
100.0
80.0
60.0
40.0
20.0
0.0
Time (seconds)
0
100
200
300
400
500
600
700
800
900
1000

FIBROUS LAYER PROVIDING IMPROVED POROSITY CONTROL FOR NONWOVEN WEBS

BACKGROUND OF THE INVENTION

The present invention concerns nonwoven materials mainly for personal care products like diapers, training pants, swim wear, absorbent underpants, adult incontinence products and feminine hygiene products. This material may also be used other applications such as, for example, in bandages and wound dressings, nursing pads and veterinary applications.

Personal care articles usually have multiple layers of material of some sort to absorb liquids from the body. These layers may include natural fibers, synthetic fibers and superabsorbent particles in varying proportions. When liquid such as urine is deposited into a personal care product like a diaper, it goes through the uppermost layers, typically a liner against the body and a "surge" layer designed to provide temporary liquid hold-up. The product may also have a "distribution" layer designed to move liquid in the X and Y directions in order to utilize more of the absorbent core. After going through these upper layers, the urine enters the absorbent core portion of the product. The absorbent core permanently retains the liquid. Absorbent cores are typically composed of superabsorbent particles or mixtures of superabsorbent particles and pulp.

Controlling the location of deposition of liquid to the absorbent core and also the rate of absorption of liquid by the absorbent core are very important to the efficient usage of the core. If superabsorbent is allowed to swell uncontrollably, it will eventually block entry of fluid without entirely using the capacity of the superabsorbent located farther into the structure. It is desirable, therefore, to allow superabsorbent to swell in a controlled manner and to a controlled degree so that absorbent core pore integrity is maintained.

Absorbency of superabsorbents may be limited by physical constraints imposed upon the system. The rate of progress of the liquid in the Z-direction, i.e. from point of initial deposition through the product away and from the wearer, may be affected by the permeability of the layers through which the liquid travels. Permeability is in turn affected by such factors as the porosity, wettability and density of the material. Controlling the movement of liquid in the Z-direction also affects the spreading of liquid in the X and Y directions.

Previous methods of controlling the flow of liquid through a product have included the provision of a film layer, which may be apertured, between the liner and absorbent core. This involves additional manufacturing steps in the placing of the film and is relatively expensive. There remains a need, therefore, for a system that will have good liquid intake properties and utilize more of the absorbent core, yet be relatively simple from a manufacturing perspective.

SUMMARY OF THE INVENTION

In response to the discussed difficulties and problems encountered in the prior art, a new fibrous layer for use in personal care products has been discovered, where the layer has the ability to control the porosity of the layer and so the Z-directional movement of liquid and is relatively easy to carry out on a commercial level. This may be seen in wicking data comparing the fabric according to the invention to controls. The fibrous layer has micro-fine fibers deposited as an aqueous slurry onto it, and subsequently dried. The micro-fine fibers can have a diameter from a positive amount to 0.5 microns. The fibrous nonwoven web may be made by many known processes, including meltblowing, spunbonding, coforming, bonding and carding, and airlaying.

In one embodiment, the fibrous layer has between 0.1 and 5 weight percent micro-fine fibers. In another, the nonwoven web is made of inherently wettable fibers. The nonwoven fibers may also be made from hydrophilically modified polymers. The fibrous layer of this invention may be used in many different personal care product applications. Personal care products include diapers, training pants, incontinence products, bandages and sanitary napkins.

BRIEF DESCRIPTION OF THE DRAWING

The FIGURE is a graphical representation of the data given in the Table below for vertical wicking distance in mm on the Y-axis versus time in seconds on the X-axis.

DEFINITIONS

"Disposable" includes being disposed of after a single use and not intended to be washed and reused.

"Liquid communications" means that liquid is able to travel from one layer to another layer, or one location to another within a layer.

As used herein the term "nonwoven fabric or web" means a web having a structure of individual fibers or threads, which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

"Spunbonded fibers" refers to small diameter fibers that are formed by extruding molten thermoplastic material as filaments from a plurality of fine capillaries of a spinneret. Such a process is disclosed in, for example, U.S. Pat. No. 3,802,817 to Matsuki et al. The fibers may also have shapes such as those described, for example, in U.S. Pat. No. 5,277,976 to Hogle et al. which describes fibers with unconventional shapes.

"Bonded carded web" refers to webs that are made from staple fibers which are sent through a combing or carding unit, which separates or breaks apart and aligns the staple fibers in the machine direction to form a generally machine direction oriented fibrous nonwoven web. This material may be bonded together by methods that include point bonding, ultrasonic bonding, adhesive bonding, etc.

As used herein, the term "coform" means a process in which at least one meltblown diehead is arranged near a chute through which other materials are added to the web or fiber stream while it is forming. Such other materials may be pulp, superabsorbent particles, natural polymers (for example, rayon or cotton fibers) and/or synthetic polymers (for example, polypropylene or polyester) fibers, for example, where the fibers may be of staple length. Coform processes are shown in commonly assigned U.S. Pat. No. 4,818,464 to Lau and U.S. Pat. No. 4,100,324 to Anderson et al. Webs produced by the coform process are generally referred to as coform materials.

"Airlaying" is a well-known process by which a fibrous nonwoven layer can be formed. In the airlaying process, bundles of small fibers having typical lengths ranging from about 3 to about 52 millimeters (mm) are separated and entrained in an air supply and then deposited onto a forming screen, usually with the assistance of a vacuum supply. The randomly deposited fibers then are bonded to one another using, for example, hot air or a spray adhesive. Airlaying is taught in, for example, U.S. Pat. No. 4,640,810 to Laursen et al.

"Personal care product" means diapers, training pants, swim wear, absorbent underpants, adult incontinence products, feminine hygiene products, bandages and wound dressings, nursing pads and veterinary applications.

TEST METHODS AND MATERIALS

Basis Weight: A circular sample of 3 inches (7.6 cm) diameter is cut and weighed using a balance. Weight is recorded in grams. The weight is divided by the sample area. Five samples are measured and averaged.

Material caliber (thickness): The caliper of a material is a measure of thickness and Is measured at 0.05 psi (3.5 g/cm$^2$) with a STARRET® bulk tester, in units of millimeters. Samples are cut into 4 inch by 4 inch (10.2 cm by 10.2 cm) squares and five samples are tested and the results averaged.

Density: The density of the materials is calculated by dividing the weight per unit area of a sample in grams per square meter (gsm) by the material caliper in millimeters (mm). The caliper should be measured at 0.05 psi (3.5 g/cm$^2$) as mentioned above. The result is multiplied by 0.001 to convert the value to grams per cubic centimeter (g/cc). A total of five samples are evaluated and averaged for the density values.

Vertical wicking: Samples of the dried nonwoven webs are cut into appropriately sized pieces. About 2.5 cm of one end of the sample is placed in a 0.9 weight percent saline solution containing (blue) dye. As time passes, the distance wicked in the material is recorded. The sample is weighed before the test and, after the test, is cut into equally sized pieces along the length of the sample, that are individually weighed. The wet weight is totaled and the dry weight subtracted from the total to yield the weight of liquid absorbed. The weight of liquid in each piece of sample divided by the total liquid amount in the sample is the percentage of liquid in each sample piece.

DETAILED DESCRIPTION OF THE INVENTION

This invention relates to a fibrous layer used in a personal care product to provide improved porosity control for nonwoven layers.

As mentioned above, films have been suggested for use as "transfer delay" layers in personal care products in order to slow the Z-directional progress of liquid through the product. The subsequent spreading of liquid in the X-Y plane encourages the use of more of the absorbent core than would otherwise be accomplished. Unfortunately, the production of film, its aperturing, rolling, unrolling, placement, and other handling and transportation issues make the use of film relatively expensive. A more economical and process friendly alternative would be welcome and is provided herein.

The inventors have discovered that a thin layer of a fibrous material that may be applied as an aqueous slurry provides good control over the porosity of a web. Such a method of deposition is quite amenable to use in modem manufacturing facilities and avoids storage and handling of cumbersome rolls of material. By controlling the process parameters such as slurry concentration, the porosity of the fibrous layer may be adjusted.

This fibrous material is one having fibers with very small average diameters (micro-fine fibers), on the order of tenths of a micron, preferably from a positive amount to 0.5 microns, and great lengths. This small diameter results in very high surface area per unit length of fiber, also allowing it to perform as a binder. In way of contrast, typical cellulosic fibers, for example, have diameters from about 30 to 300 microns and typical nonwoven thermoplastic fibers have diameters from about 7 to 50 microns. The fibrous material preferably has a negative charge, which also aids its ability to perform as a binder.

One material useful in the production of micro-fine fibers is known as microbial or bacterial cellulose. These fibers are wettable, negatively charged and produced by agitated bacteria. A commercially available bacterial cellulose is that known as CELLULON® cellulose and is sold by Kelco Biopolymers of San Diego, Calif. CELLULON®) cellulose has been used in the paper making industry for some time as a binder. The use of CELLULON® cellulose in nonwoven applications as a binder is discussed by Miskiel in the TAPPI Journal (vol. 81, no. 3, p. 183–186). Miskiel teaches the blending of CELLULON® cellulose with various fibers and the subsequent production of nonwovens having improved tensile strength. This method, while improving tensile strength, does not provide a way to control porosity in a simple manner adapted for use in commercial manufacturing processes. The Invention disclosed herein, by contrast, provides a separate fibrous layer made by an easily controlled method which may be adapted to virtually any previously formed nonwoven web.

Other examples of micro-fine fibers include those taught in U.S. Pat. No. 5,935,883 to Pike and U.S. Pat. No. 5,759,926 to Pike et al. In these patents, conjugate fibers are produced wherein each polymer is placed in multiple portions of the fiber cross section with the other polymer on either side of it, like slices of a pie. The segments of the fibers disassociate from each other very quickly, either spontaneously or upon the application of stress of some sort, like high temperature.

The polymers for use in this invention are preferably hydrophilic or may be modified to be hydrophilic. Inherently hydrophilic polymers include natural polymers like rayon and regenerated cellulose, copolymers of caprolactam and alkylene oxide diamine, copolymers of poly(oxyethylene) and polyurethane, polyamide, polyester or polyurea, e.g. absorbent thermoplastic polymers disclosed in U.S. Pat. No. 4,767,825 to Pazos et al., ethylene vinyl alcohol copolymers and the like.

Hydrophilically modifiable polymers include polyolefins, polyesters, polyamides, polycarbonates, and copolymers and blends thereof. Suitable polyolefins include polyethylenes like high, medium, low and linear low density polyethylene, polypropylene, polybutylene, polypentene, isoprene, and blends thereof. Suitable polyamides include nylon 6, nylon 6/6, nylon 416, nylon 11, nylon 12, copolymers of caprolactam and alkylene oxide diamine and the like, as well as copolymers and blends thereof. Suitable polyesters include polyethylene terephthalate, polybutylene terephthalate, polytetramethyl terephthalate, polycyclohexylene-1,4-dimethylene terephthalate and isophthalate copolymers thereof, as well as blends thereof.

Surfactants that can modify the surface of a fiber may be applied topically or may be internally added. Internally added surfactants may be chosen to have little compatibility with the main polymer of the fiber and migrate readily to the surface. Such migration or "blooming" may be hastened by the application of a suitable amount of heat or may occur without encouragement. Examples of such surfactants include silicon based surfactants like polyalkylene-oxide modified polydimethyl siloxane, fluoro-aliphatic surfactants like perfluoroalkyl polyalkylene oxides and other surfactants, e.g., actylphenoxypolyethyoxy ethanol nonionic surfactants, alkylaryl polyether alcohols, and polyethylene oxides. Numerous commercially available surfactants are known to those skilled in the art.

Nonwoven webs are typically made from a number of processes such as spunbonding and meltblowing, which involve the melting of thermoplastic polymer and deposition onto a conveyor belt or "forming wire"; bonding and carding, involving the orienting and bonding of individual fibers; coforming, where fibers are added to a meltblowing process; and airlaying, which involves the air-driven deposition of fibers. Once formed, nonwoven webs may be directly used to produce products or may be stored for later use. The slurry of micro-fine fibers may be deposited onto the nonwoven web as it is produced or may be deposited at a later time when it is being used in the production of a product.

Materials for use in the nonwoven process include natural fibers and synthetic polymers in fibrous form or which may be fiberized.

Natural fibers include wool, cotton, flax, hemp and wood pulp. Wood pulps include standard softwood fluffing grade such as CR-1654 (US Alliance Pulp Mills, Coosa, Ala.). Pulp may be modified in order to enhance the inherent characteristics of the fibers and their processability. Curl may be imparted to the fibers by methods including chemical treatment or mechanical twisting. Curl is typically imparted before crosslinking or stiffening. Pulps may be stiffened by the use of crosslinking agents such as formaldehyde or its derivatives, glutaraldehyde, epichlorohydrin, methylolated compounds such as urea or urea derivatives, dialdehydes such as maleic anhydride, non-methylolated urea derivatives, citric acid or other polycarboxylic acids. Some of these agents are less preferable than others due to environmental and health concerns. Pulp may also be stiffened by the use of heat or caustic treatments such as mercerization. Examples of these types of fibers include NHB416 which is a chemically crosslinked southern softwood pulp fibers which enhances wet modulus, available from the Weyerhaeuser Corporation of Tacoma, Wash. Other useful pulps are debonded pulp (NF405) and non-debonded pulp (NB416) also from Weyerhaeuser. HPZ3 from Buckeye Technologies, Inc of Memphis, Tenn., has a chemical treatment that sets in a curl and twist, in addition to imparting added dry and wet stiffness and resilience to the fiber. Another suitable pulp is Buckeye HP2 pulp and still another is IP SUPERSOFT pulp from International Paper Corporation. Suitable rayon fibers are 1.5 denier MERGE 18453 fibers from Acordis Cellulose Fibers Incorporated of Axis, Ala.

Synthetic polymers for fiber production include polyolefins, polyamides and polyesters. The fibers may be produced as monocomponent fibers or as conjugate fibers. Many polyolefins are available for fiber production, for example polyethylenes such as Dow Chemical's ASPUN® 6811A linear low density polyethylene, 2553 LLDPE and 25355 and 12350 high density polyethylene are such suitable polymers. The polyethylenes have melt flow rates, respectively, of about 26, 40, 25 and 12. Fiber forming potypropylenes include Exxon Chemical Company's ESCORENE® PD 3445 polypropylene. Polyolefins suitable for nonwoven processes also include those formed by the metallocene process. Suitable fibers also include sheath core conjugate fibers available from KoSa Inc. (Charlotte, N.C.) under the designations T-254 (low melt COPET), T-255 (polyethylene/polyethyleneterephathalate) and T-256 (copolyester). Chisso Corp. (Japan) and Fibervisions LLC of Wilmington, also produce fibers appropriate for use in this invention.

The micro-fine fiber aqueous slurry may be made by diluting the desired amount of micro-fine fiber in the appropriate amount of water. Such processes are known in the art and will not be recounted here. Amounts of micro-fine fiber added to water suitable for the practice of this invention should be between about 0.1 and 5 weight percent, more particularly about 1 weight percent based on the weight of fiber and water used. The amount of micro-fine fiber added to the nonwoven web may desirably be between 0.5 and 5 weight percent based on the weight of the web.

After deposition onto the web, the slurry is dried, driving off the water and leaving the dried residue, which is the fibrous matrix of micro-fine fibers. Drying may be done by any suitable method known in the art. One method is to pass the nonwoven web over or around heated drums, known as steam cans. Drying may also be done by passing the wet web through a conventional drying oven or under infrared lamps.

An Example of the invention is given below.

EXAMPLE

Airlaid—The airlaid material was made from a 90/10 blend of NF405 pulp and Kosa T-255 conjugate fibers. The nonwoven web had a basis weight of 175 gsm and a density of 0.08 gm/cc. Samples were cut from this web and were about 250 mm long, 60 mm wide, 2 mm thickness and had a weight of about 2.75 grams.

After formation of a web by the above method, an aqueous slurry of micro-fibers was deposited onto it The aqueous slurry contained 0.5 weight percent CELLULON® microbial cellulose from Kelco Biopolymers and 0.15 weight percent CMC7L cellulose gum stabilizer from Aqualon, a Division of Hercules Inc., of Wilmington, Del. This was added to different samples of each web by spraying at rates of 1.2 weight percent, 2.4 weight percent, 4.8 weight percent and, as a control, zero weight percent. The slurry was dried by passing the wet web around steam cans, leaving the dried residue of micro-fibers on top of the web. The side of the web that was sprayed with the slurry was the side against the steam can and was the side on which readings for the vertical wicking test were taken. Sizes and weights for the average of five samples at each concentration are given in the Table.

The vertical wicking test result data is given in the Table and in the FIGURE in graphical form. The FIGURE is a graph of the data from the Table for airlaid material with tirne in 100 second increments on the X-axis and vertical wicking distance in 20 mm increments on the Y-axis. The lowest line on the FIGURE, denoted by diamonds, has zero weight percent CELLULON® microbial cellulose added. The line on the FIGURE denoted by squares has 1.2 weight percent CELLULON® microbial cellulose added. The line on the FIGURE denoted by triangles has 2.4 weight percent CELLULON® microbial cellulose added. The line on the FIGURE denoted by large Xs has 4.8 weight percent CELLULON® microbial cellulose added and is the top line of the FIGURE from about 400 seconds onward.

The table also shows the weight of liquid in each zone of material where zone 1 is the end of the material in the liquid and zone 9 is the farthest zone from the liquid and the zones are equally sized along the length of the material. The data shown are averages from five samples at each treatment level.

TABLE

| % Microbial Cellulose | 0 | 1.2 | 2.4 | 4.8 |
|---|---|---|---|---|
| Length (mm) | 252.40 | 249.60 | 248.33 | 248.00 |
| Width (mm) | 61.80 | 61.40 | 61.67 | 60.20 |
| Weight (gms) | 2.75 | 2.74 | 2.82 | 2.90 |
| Thickness (mm) | 2.14 | 2.07 | 2.03 | 2.89 |
| Thickness (mm) | 2.07 | 2.08 | 2.06 | 2.51 |
| Thickness (mm) | 2.08 | 2.07 | 2.11 | 2.80 |
| Wicking Time (seconds) | | | | |
| 15 | 34 | 37 | 36 | 37 |
| 30 | 49 | 48 | 49 | 50 |
| 45 | 54 | 55 | 57 | 56 |
| 60 | 57 | 61 | 62 | 62 |
| 120 | 63 | 70 | 72 | 73 |
| 180 | 67 | 77 | 78 | 79 |
| 300 | 74 | 84 | 86 | 87 |
| 450 | 78 | 90 | 91 | 93 |
| 600 | 80 | 96 | 95 | 98 |
| 750 | 81 | 99 | 99 | 101 |
| 900 | 82 | 101 | 102 | 106 |
| Wet Weight per Zone | | | | |
| 1 | 4.06 | 3.72 | 3.25 | 3.76 |
| 2 | 3.20 | 3.10 | 3.06 | 3.13 |
| 3 | 2.87 | 2.59 | 2.62 | 2.65 |
| 4 | 1.66 | 1.40 | 1.51 | 1.48 |
| 5 | 0.38 | 0.55 | 0.65 | 0.74 |
| 6 | 0.28 | 0.28 | 0.29 | 0.33 |
| 7 | 0.28 | 0.29 | 0.28 | 0.28 |
| 8 | 0.28 | 0.28 | 0.28 | 0.31 |
| 9 | 0.27 | 0.29 | 0.29 | 0.30 |

As can be seen from the data, the addition of micro-fine fibers results in the increased vertical wicking of all samples and reduced retention of liquid in the very first area of the fabric. This shows the improvement wicking performance of the material of this invention.

As will be appreciated by those skilled in the art, changes and variations to the invention are considerate to be within the ability of those skilled in the art. Such changes and variations are intended by the inventors to be within the scope of the invention.

What is claimed is:

1. A fibrous layer for personal care products comprising micro-fine fibers deposited as an aqueous slurry onto a nonwoven web that is inherently wettable or treated to be hydrophilic, and subsequently dried.

2. The fibrous layer of claim 1 wherein said nonwoven web is produced from a method selected from the group consisting of meltblowing, spunbonding, coforming, bonding and carding, and airlaying.

3. The fibrous layer of claim 1 wherein said nonwoven web has between 0.1 and 5 weight percent micro-fine fibers.

4. The fibrous layer of claim 3 wherein said deposited microfine fibers have a negative charge.

5. The fibrous layer of claim 3 wherein said deposited microfine fibers are wettable.

6. The fibrous layer of claim 1 wherein said nonwoven web comprises inherently wettable fibers.

7. The fibrous layer of claim 1 wherein said nonwoven web comprises hydrophilically modified polymers.

8. A diaper comprising the fibrous layer of claim 1.

9. A training pant comprising the fibrous layer of claim 1.

10. An incontinence product comprising the fibrous layer of claim 1.

11. A bandage comprising the fibrous layer of claim 1.

12. A sanitary napkin comprising the fibrous layer of claim 1.

13. The fibrous layer of claim 1 wherein said deposited microfine fibers have a negative charge.

14. The fibrous layer of claim 1 wherein said deposited microfine fibers are wettable.

* * * * *